US006695579B2

(12) United States Patent
Meng

(10) Patent No.: US 6,695,579 B2
(45) Date of Patent: Feb. 24, 2004

(54) DIFFUSER HAVING A VARIABLE BLADE HEIGHT

(75) Inventor: Sen Yih Meng, Reseda, CA (US)

(73) Assignee: The Boeing Company, Seattle, WA (US)

( * ) Notice: Subject to any disclaimer, the term of this patent is extended or adjusted under 35 U.S.C. 154(b) by 7 days.

(21) Appl. No.: 10/175,633

(22) Filed: Jun. 20, 2002

(65) Prior Publication Data

US 2003/0235497 A1 Dec. 25, 2003

(51) Int. Cl.[7] ..... F04D 29/46
(52) U.S. Cl. ..... 415/208.3; 415/211.1
(58) Field of Search ..... 415/224.5, 208.2, 415/208.3, 211.1

(56) References Cited

U.S. PATENT DOCUMENTS

| | | | |
|---|---|---|---|
| 3,372,862 | A | 3/1968 | Koenig, III |
| 4,086,022 | A | 4/1978 | Freeman et al. |
| 4,131,389 | A | 12/1978 | Perrone et al. |
| 4,368,005 | A | 1/1983 | Exley et al. |
| 4,405,102 | A | 9/1983 | Taylor |
| 4,414,815 | A | 11/1983 | Conrad |
| 4,445,816 | A | 5/1984 | Ribaud et al. |
| 4,664,345 | A | 5/1987 | Lurz |
| 4,790,720 | A | 12/1988 | Rodgers |
| 4,877,370 | A | 10/1989 | Nakagawa et al. |
| 4,877,373 | A | 10/1989 | Bandukwalla |
| 4,900,225 | A | 2/1990 | Wulf et al. |
| 4,932,835 | A | 6/1990 | Sorokes |
| 4,969,798 | A | 11/1990 | Sakai et al. |
| 4,979,361 | A | 12/1990 | Clark et al. |
| 5,316,441 | A | 5/1994 | Osborne |
| 5,320,489 | A | 6/1994 | McKenna |
| 5,417,547 | A | 5/1995 | Harada |
| 5,529,457 | A | 6/1996 | Terasaki et al. |
| 5,709,531 | A | 1/1998 | Nishida et al. |
| 6,203,275 | B1 | 3/2001 | Kobayashi et al. |
| 6,210,104 | B1 | 4/2001 | Schonenborn |

*Primary Examiner*—Edward K. Look
*Assistant Examiner*—Kimya N McCoy
(74) *Attorney, Agent, or Firm*—Alston & Bird LLP

(57) ABSTRACT

A diffuser for converting high velocity fluid into high pressure fluid. The diffuser includes a pair of spaced opposing walls between which extend a plurality of blades. Each of the blades has a pressure side and a suction side, wherein the pressure side of one of the blades is adjacent the suction side of another one of the blades. Each pair of adjacent blades and spaced walls define a channel that extends from an inlet end to an outlet end with a generally increasing cross-sectional area. The suction side of each blade has a height greater than the pressure side of the adjacent blade defining the channel whereby the fluid is less likely to stall due to separation from the suction side. Each blade has a leading edge positioned at a 10° angle further minimizing the incidence of stall and increasing the operating range of the diffuser.

20 Claims, 7 Drawing Sheets

DIFFUSER HAVING A VARIABLE BLADE HEIGHT

BACKGROUND OF THE INVENTION

1) Field of the Invention

The present invention is related to the use of diffusers to convert high-velocity fluids to high-pressure fluids, and more particularly to diffusers including a plurality of blades to direct and convert fluid flow.

2) Description of Related Art

Typically, a pump or compressor accelerates the velocity of fluid flow and then uses a diffuser to convert the increased velocity of the flow to an increase in pressure of the flow. For instance, a centrifugal compressor includes a rotating impeller having a plurality of helical blades that redirect and accelerate fluid flow from an axial direction to a radial direction. Around the periphery of the rotating impeller, and in fluid communication with the chamber in which the impeller blades are disposed due to its close proximity to the impeller blades, is a diffuser. The diffuser includes a plurality of static, radially extending blades bracketed by an upper and lower shroud so as to define a plurality of channels. These channels have an inlet end defined at the periphery of the impeller and extend to an outlet end at the outer periphery of the diffuser. Generally, the cross-sectional area of each channel increases as it extends from the inlet to the outlet, and as the fluid flows therethrough its velocity drops and its pressure increases. The relatively high pressure fluid is captured by a volute surrounding the diffuser. The volute is a scroll-shaped casing with a roughly circular cross-section having an area that increases as a function of wrap angle defined by the tangential direction of fluid flow emerging from the diffuser.

The operating range of most pumps and compressors is limited due to the instability resulting from stalling of the pumped fluid in the diffuser. Generally, stall is thought to be a result of the fluid flow separating from the suction side of the diffuser blades. In centrifugal pumps, separation of flow from the blades is more likely to occur when the angle of the leading edge of the diffuser blade differs greatly from the angle of flow of the fluid. Because variation in the velocity of the fluid exiting the impeller causes the angle of fluid flow to vary, the incidence of stall limits the range of speeds at which the impeller may operate. The range of impeller speeds over which stall does not occur is typically referred to as the "operating range" of the pump or compressor.

In an effort to increase the operating range of pumps or compressors, multiple blades of varying angles can be used. U.S. Pat. No. 4,877,370 to Nakagawa et al. ("Nakagawa") discloses a diffuser for a centrifugal compressor that includes three differently sized and angled blades. As shown in FIG. 2 of Nakagawa, the blades consist of a plurality of main blades 7, inner sub-blades 8 and intermediate blades 9 at the outer periphery of the diffuser. Each intermediate blade is positioned so as to restrict the flow near the rear end of its adjacent main blade so as to prevent separation of the fluid from the main blade. Similarly, the sub-blades reduce the incidence of stall by being rotatably adjustable to more closely match the angle of the fluid flow at various operating speeds, as shown in FIGS. 8 and 9 of Nakagawa. Notably, U.S. Pat. No. 4,877,373 to Bandukwalla; U.S. Pat. No. 4,932,835 to Sorokes; U.S. Pat. No. 4,969,798 to Sakai et al.; U.S. Pat. No. 5,316,441 to Osborne; U.S. Pat. No. 5,320,489 to McKenna; and U.S. Pat. No. 5,529,457 to Terasaki et al. also disclose diffusers having multiple blade types for reducing the incidence of stall. Despite improvements in operating range, such diffusers are expensive to manufacture and the diffusers with moving blades are generally less robust than those with stationary blades.

Therefore, it would be advantageous to have a diffuser for use with a pump or compressor that efficiently converts high velocity fluids to high pressure fluids through a large operating range. Further, it would be advantageous to have a diffuser that is relatively inexpensive to manufacture and does not have a large number of moving parts so as to reduce maintenance requirements.

BRIEF SUMMARY OF THE INVENTION

The present invention addresses the above needs and achieves other advantages by providing a diffuser for converting high velocity fluid into high pressure fluid. The diffuser includes a pair of spaced opposing walls between which extend a plurality of blades. Each of the blades has a pressure side and a suction side, wherein the pressure side of one of the blades is adjacent the suction side of another one of the blades. Thus, each pair of adjacent blades and spaced walls define a channel that extends from an inlet end to an outlet end. The cross-sectional area of the channel generally increases as it extends from the inlet end to the outlet end. As a result, high velocity fluid entering the inlet end becomes a high pressure fluid as it flows to the outlet end. Advantageously, the suction side of the blade has a height greater than the pressure side whereby the fluid is less likely to stall due to separation from the suction side. In addition, each blade preferably has a leading edge positioned at an angle of 10° or less to further minimize the incidence of stall and increase the operating range of the diffuser.

In one embodiment, a diffuser is provided for converting a high velocity fluid into a high pressure fluid. The diffuser includes a pair of spaced, opposing walls, a pressure surface and a suction surface. The pressure surface extends between the pair of spaced, opposing walls and has a first height. The suction surface also extends between the pair of spaced, opposing walls, but has a second height that is greater than the first height. The walls and surfaces define a channel having a first end, a second end and a generally increasing cross-sectional area as it extends from the first end to the second end. High velocity fluid entering into the first end is converted into high pressure fluid as it flows along the channel to its second end by virtue of the generally increasing cross-sectional area. Advantageously, the height difference between the suction and pressure surfaces decreases the incidence of stall.

In another embodiment, a diffuser is provided comprising a pair of spaced, opposing walls and a plurality of diffuser blades. Each of the diffuser blades defines a pressure surface and a suction surface. The pressure surface has a first height extending between the pair of spaced, opposing walls. The suction surface has a second height extending between the pair of spaced, opposing walls wherein the second height is greater than the first height. The diffuser blades are spaced apart from each other so that the pressure surface of each blade is opposite the suction surface of an adjacent one of the blades. In this manner, the walls and surfaces define a channel having a first end, a second end and a generally increasing cross-sectional area as it extends from the first end to the second end. High velocity fluid entering into the first end is converted to high pressure fluid by virtue of the generally increasing cross-sectional area.

In yet another embodiment, an annual diffuser has a pair of spaced, opposing walls and a plurality of diffuser blades arranged in a generally annular, spaced relationship. Further, the blades are positioned so that a pressure surface of one blade is opposite a suction surface of another blade. The pressure surface has a first height extending between the pair of opposing walls while the suction surface has a second, greater height extending between the pair of opposing walls. A radially extending channel is defined by the walls and surfaces. The radially extending channel has a first end, a second end and a generally increasing cross-sectional area as it extends radially from the first to second ends.

In still another embodiment, a centrifugal compressor is provided for increasing the pressure of a fluid. The centrifugal compressor includes an impeller and an annular diffuser. The impeller has a plurality of rotatable blades defining a peripheral edge during rotation. Rotation of the blades accelerates the fluid in a radial direction so that fluid exits at the perhiperal edge. The annular diffuser includes a pair of spaced, opposing walls and a plurality of diffuser blades. The blades are arranged in a generally annular, spaced relationship so that a pressure surface of one blade is opposite a suction surface of another blade. The pressure surface extends a first height between the pair of opposing walls and the suction surface extends a second, greater height, between the pair of opposing walls. A channel is defined by the opposing surfaces and walls, wherein a first end of the channel is positioned adjacent the peripheral edge of the impeller so as to receive the fluid as it exits the impeller. The channel extends radially with a generally increasing cross-sectional area to a second end so that the fluid pressure increases as it flows from the first end to the second end.

In another embodiment, the blade height H(R) varies between the pressure surface and the suction surface as a function of the radius of curvature (R) wherein $R_p < R < R_s$. Preferably, the variation ratio of the blade height is defined as $H(R)/H=0.3535[(R_p+R_s)/R]^{3/2}$.

In yet another aspect, the leading edge angle of each of the blades is preferably less than approximately 10° with respect to the tangential direction of the impeller blades at the adjacent peripheral edge.

The present invention has several advantages. The height variation between the pressure and suction surfaces in each of the channels reduces the likelihood of fluid flow separation at the suction side. Reducing the likelihood of separation reduces the critical incidence angle at which stall occurs, allowing for a larger operating range of the pump or compressor. Further reduction of the incidence of stall is accomplished by coupling the blade height variation with a leading edge blade angle less than about 10°. Further advantageously, the diffuser blades are stationary and at a single angle which is more cost-effective than diffuser designs having multiple blades at different angles and/or moveable blades.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
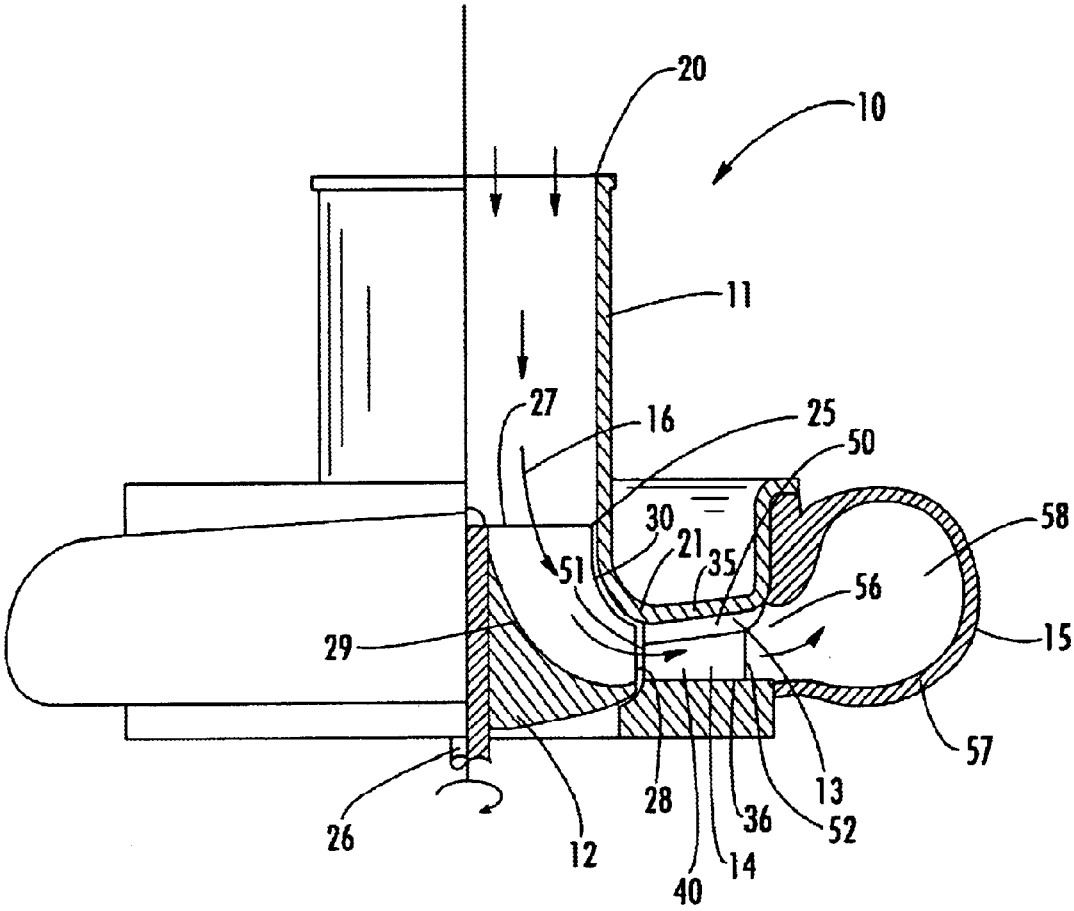
FIG. 1 is a partial sectional view of a centrifugal pump of one embodiment of the present invention.

A centrifugal pump 10 of one embodiment of the present invention includes an inlet tube or pipe 11, an impeller 12, a radial diffuser 13 with variable height blades 14 and a volute 15, as shown in FIG. 1. Generally, spinning of the impeller 12 draws fluid from the inlet tube 11 and accelerates the fluid radially into the diffuser 13. The pressure of the fluid increases as it travels radially through the diffuser 13. The high pressure fluid is collected and redirected by the volute 15 as it exits the diffuser. Although the illustrated embodiments are radial diffusers for use with centrifugal pumps, the present invention is applicable to other types of diffusers, such as linear diffuser banks, and the pumps typically associated therewith.

The inlet tube 11 of the centrifugal pump 10 embodiment supplies a low pressure, low velocity fluid (relative to the velocity of the fluid exiting the impeller 12 and the pressure of the fluid exiting the diffuser 13) in the direction of arrows 16 to the rotating impeller 12. The inlet tube 11 includes an entrance end 20 which is configured for connection to an existing pipe (not shown), such as by using a sleeve, an interference fit or by being threaded. The inlet tube 11 extends with a generally constant diameter until flaring at an exit end 21 sized to allow clearance for rotation of the impeller 12. The exit end 21 is shown in the embodiment depicted in FIG. 1 as being integrally formed with the radial diffuser 13, but may also be configured for disassembly from the radial diffuser for easy maintenance, such as by the provision of a threaded connection.

The impeller 12 of the centrifugal pump 10 includes a plurality of blades 25 extending radially outward from a shaft 26. Each of the blades 25 includes an inlet edge 27 and an outlet edge 28. The inlet edge 27 extends in a direction orthogonal to the axis of the shaft 26 and the inlet tube 11 so as to intercept incoming low pressure, low velocity fluid. Each of the impeller blades 25 spirals about the shaft 26 as it extends toward the outlet edge 28 which is adjacent the radial diffuser 13. Each of the impeller blades 25 further includes an inner edge 29 and an outer edge 30. The inner edge 29 curves radially outwards as it extends in the axial direction. The outer edge 30 also curves radially outwards so as to be congruent and adjacent to the flared exit end 21 of the inlet tube 11. As the impeller blades 25 are rotated by the shaft 26, the edges and surfaces of the blades, in cooperation with the inlet tube 11, accelerate and redirect the fluid in the radial direction and into the diffuser 13. Such acceleration converts the fluid into a "high velocity fluid" relative to the fluid entering the inlet tube 11.

Figure 2:
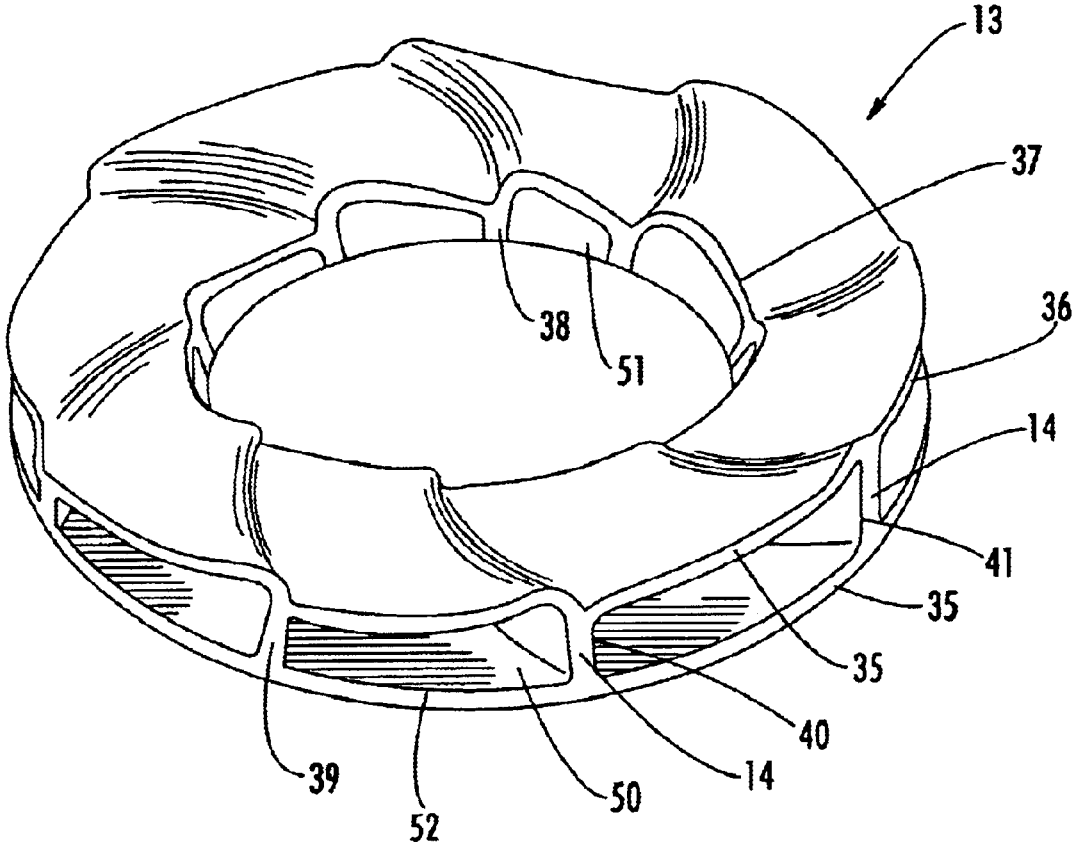
FIG. 2 is a perspective view of a radial diffuser of the centrifugal pump of FIG. 1.

FIG. 2 shows a perspective view of the radial diffuser 13 of one embodiment of the present invention, wherein the radial diffuser is separated from the remainder of the centrifugal pump 10. The diffuser includes a pair of spaced apart, opposing wall structures 35. Each of the wall structures has the general shape of an annular disk, including an outer circumference 36 and defining an inner, circular opening 37. The blades 14 of the diffuser extend between the opposing wall structures 35 and are circumferentially spaced around the inner circular opening 37. Each of the diffuser blades 14 has the shape of a curved airfoil and includes a leading edge 38, a trailing edge 39, a pressure side 40 and a suction side 41. An angle (β) is formed by the inclination of each blade with respect to the tangential direction of the impeller 12.

Figure 4:
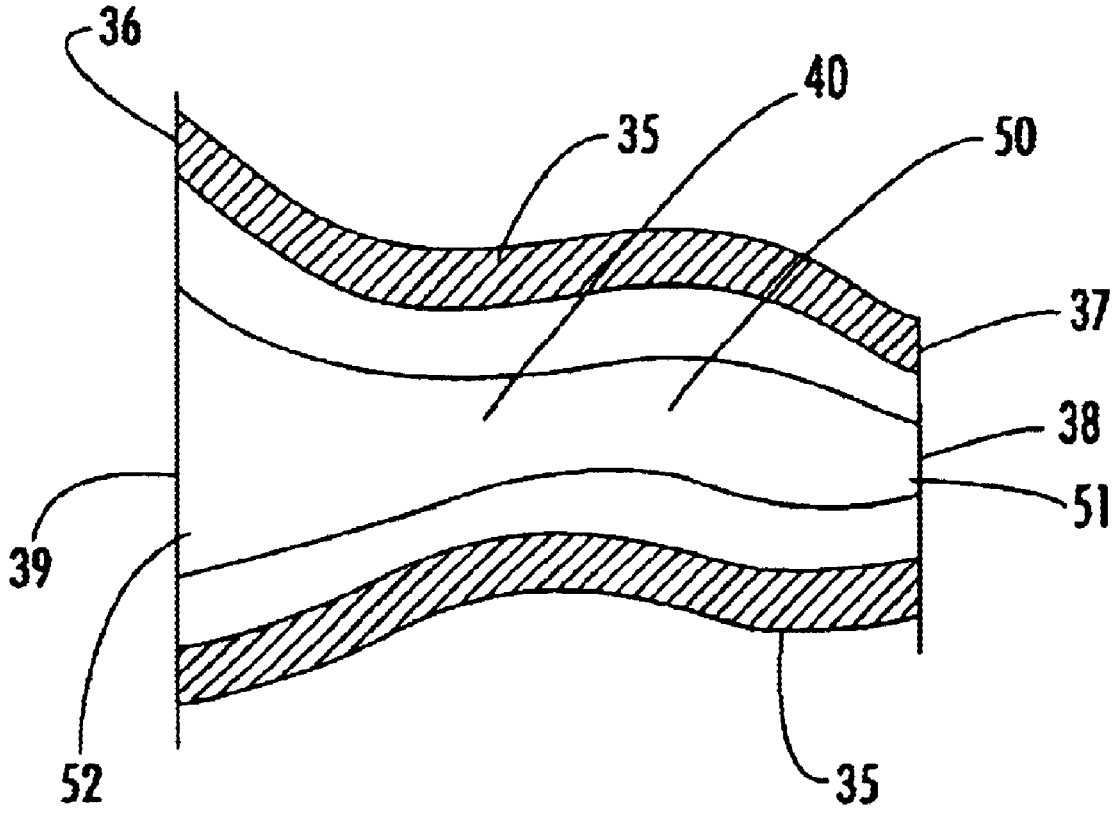
FIG. 4 is a sectional view of the radial diffuser and blades of FIGS. 2 and 3.
Figure 5:
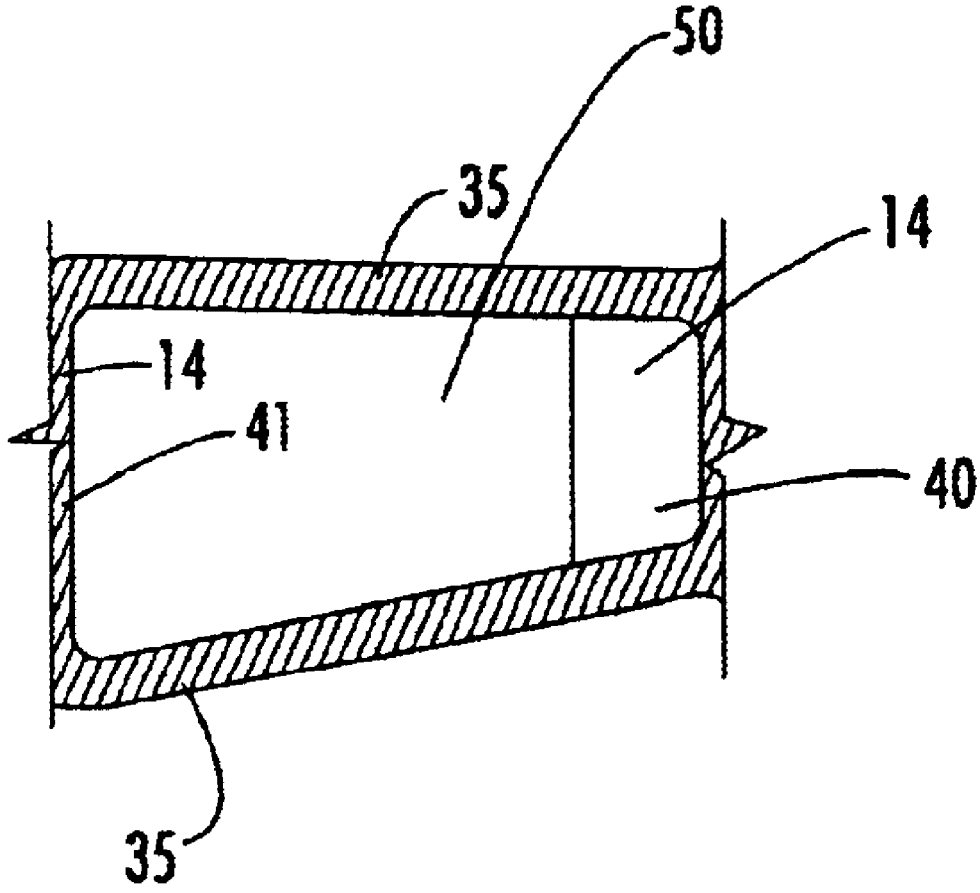
FIG. 5 is another sectional view of the radial diffuser and blades of FIGS. 2 and 3.

The walls 35 and diffuser blades 14 cooperate to form a plurality of channels 50 through which passing fluid is converted from a high velocity to a "high pressure fluid" having a pressure higher than the fluid in the inlet tube 11 and the impeller 12. As shown in FIG. 4, the opposing walls 35 define one pair of opposing surfaces of each of the channels 50. As shown in FIG. 5, the pressure side 40 of each one of the blades 14 is opposite the suction side 41 of an adjacent one of the blades so as to define a second pair of opposing surfaces of each of the channels 50. Each channel includes a first, inlet end 51 and a second, outlet end 52 wherein the cross-sectional area of the channel generally increases in the radial direction from the inlet end to the outlet end. The inlet end 51 of each channel 50 is positioned adjacent the path of travel of the peripheral, outlet edge 28 of each of the impeller blades 25, as shown in FIG. 1.

Figure 3:
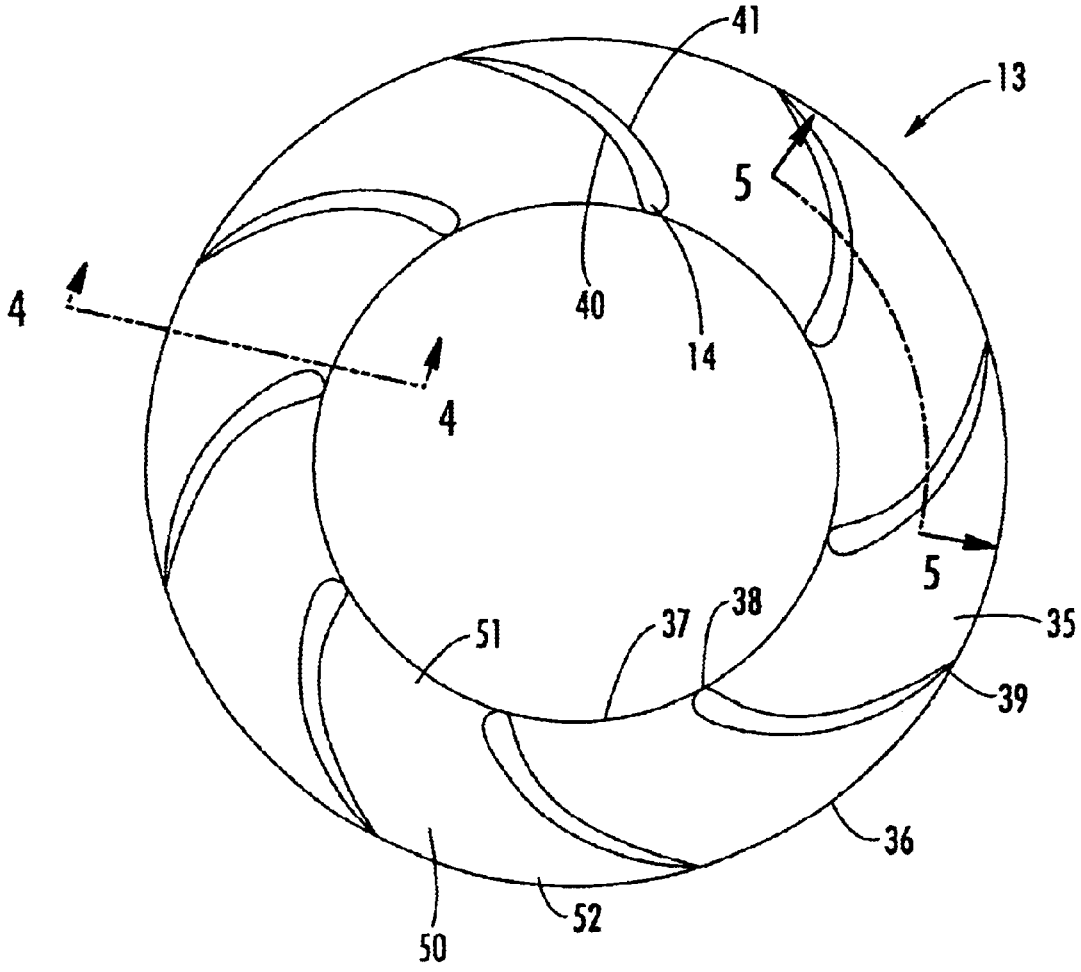
FIG. 3 is a plan view of the blades of the radial diffuser of FIG. 2.

The increase in cross-sectional area between the inlet end 51 and the outlet end 52 is due to the divergence of the pairs of opposing surfaces that define the channel 50. The opposing walls 35 generally diverge as they extend in the radial direction, as shown in FIG. 4. The term "generally diverge" is used because the opposing walls have undulating shapes and therefore may converge for a short distance in the radial direction before beginning to diverge again due to various factors, such as the desired flow patterns of different fluids within each channel. However, the area of the inlet end 51 of the channel must be smaller than the area of the outlet end 52 for diffusion of the fluid to occur. The opposing pressure side 40 and suction side 41 of the adjacent pairs of diffuser blades 14 also generally diverge in the radial direction. Divergence of the diffuser blades is by virtue of the decreasing thickness of each blade and the increasing circumferential distance between the adjacent pairs of blades as they extend in the radial direction, as shown in FIG. 3.

The radial diffuser 13 reduces the occurrence of stall through variation in the height of the diffuser blades 14 as compared to a conventional diffuser having a constant blade height (H). In particular, each diffuser blade has a height H(R) that varies between the pressure surface and the suction surface as a function of the radius of curvature (R) wherein $R_p<R<R_s$. Preferably, the variation ratio of the blade height is defined as $H(R)/H=0.3535[(R_p+R_s)/R]^{3/2}$. As shown in FIG. 5, the height of the suction side 14 is greater than the height of the opposing pressure side 40 at a section taken along a constant radius. Without being wed to theory, it is believed that the smaller height of the channel on the pressure side 40 tends to urge more fluid in the direction of the suction side 41, thereby decreasing the risk of flow separation from the suction side. Decreasing the risk of flow separation decreases the risk of stall.

The angle (β) of the leading edge 38 of each of the diffuser blades is selected so as to reduce the incidence of stall. The critical flow angle ($\alpha_c$) is the angle between the diffuser blade leading edge 38 and the fluid flow at which stall occurs. The critical flow angle is represented by:

$$\alpha_c=\beta-\alpha_f$$

wherein $\alpha_f$ is the angle of fluid flow at which stall occurs with respect to the tangential direction defined by rotation of the impeller blades 25. Such diffuser terminology is drawn from the two-dimensional diffuser analogy described in "Performance and Design of Straight, Two-dimensional Diffusers," Thermoscience Division Engineering, Stanford University, September 1964 by L. R. Reneau, J. P. Johnston and S. J. Kline which is incorporated herein by reference. The relationship between the diffuser leading edge angle (β) and the critical incidence angle ($\alpha_c$) can be predicted by the following two equations:

$$\alpha_c/\beta=-4.22260610569939E-7\beta^4+0.000041888413223126\beta^3-0.00162833535766091\beta^2+0.0290904298668765\beta+0.334521446394925; \quad \text{Equation 1:}$$

and $$\alpha_c/\beta=-2.17169030737379E-7\beta^4+0.000024448604761838 2\beta^3-0.00111450272723107\beta^2+0.0290904298668765\beta+0.284416606328034. \quad \text{Equation 2:}$$

Figure 6:
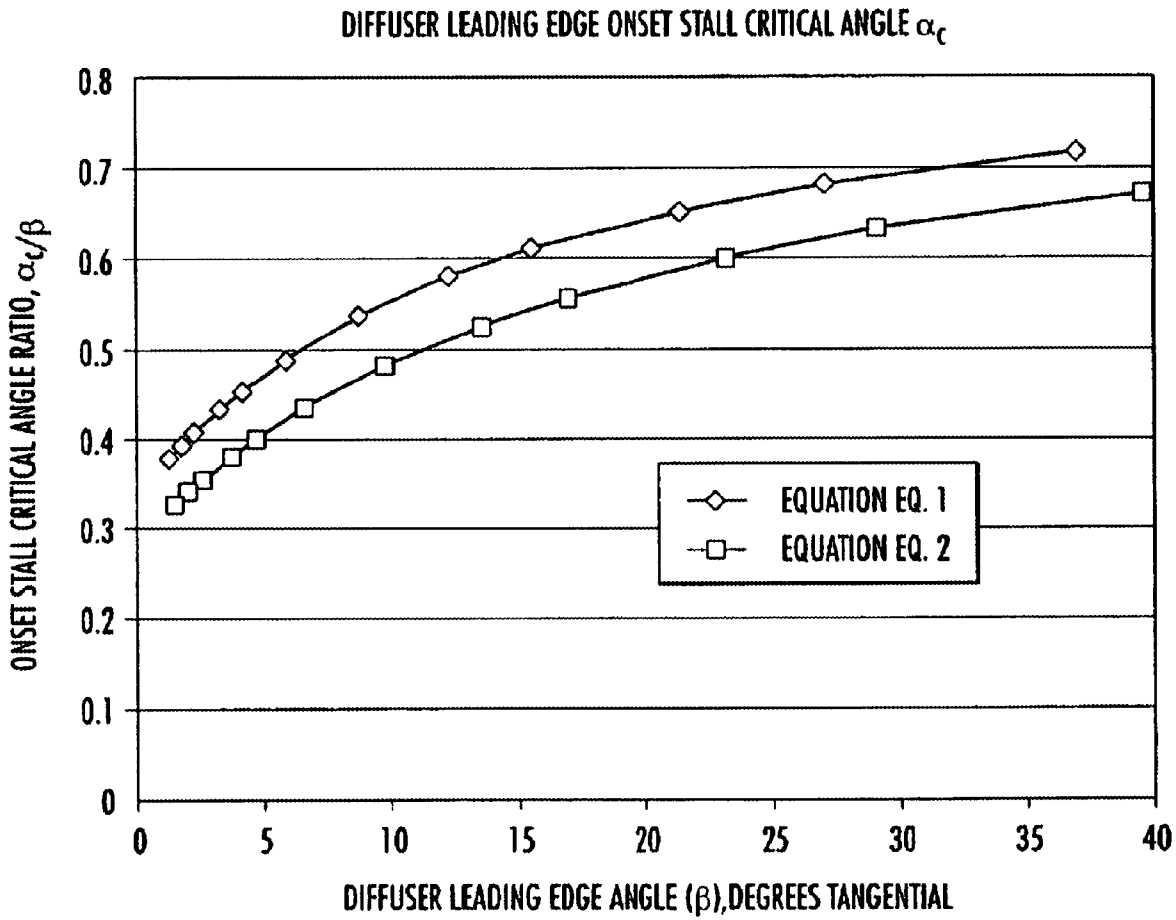
FIG. 6 is a graphical depiction of the critical stall angle in relation to the leading edge angle of the diffuser blades shown in FIG. 3.
Figure 7:
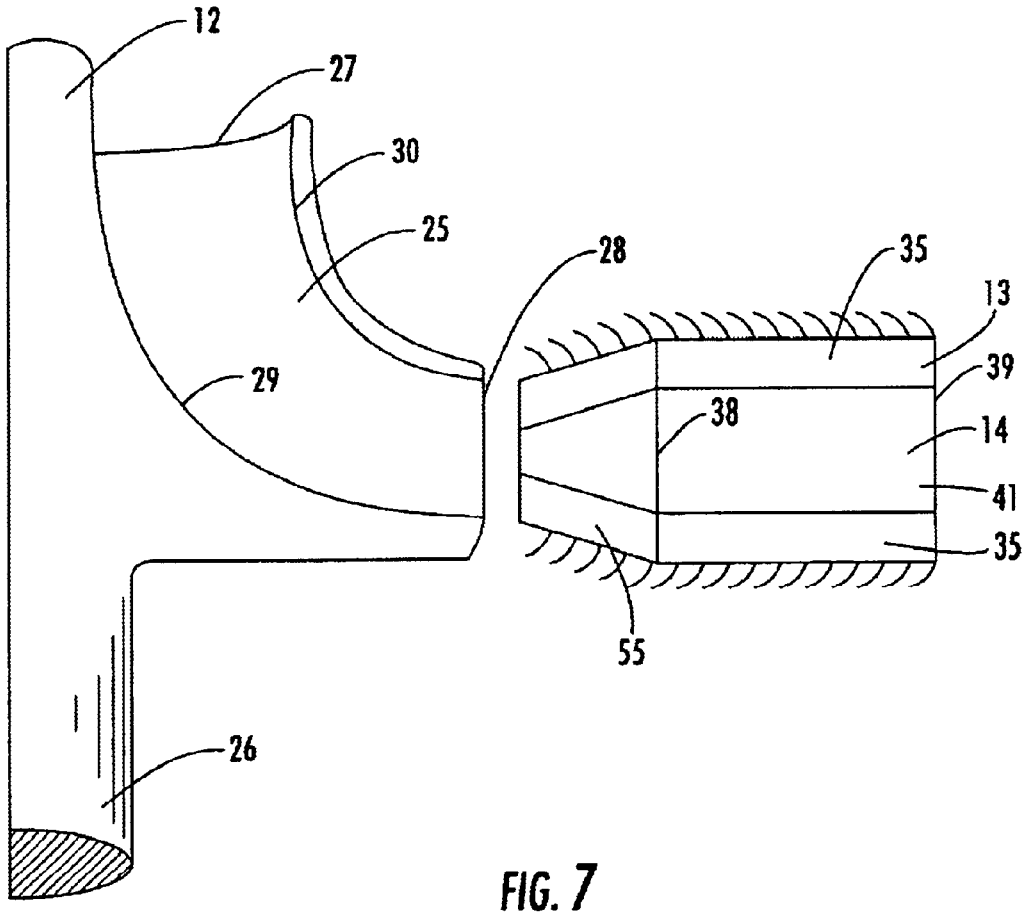
FIG. 7 is a schematic of a centrifugal compressor of another embodiment of the present invention including an annular diffuser bank between an impeller and a diffuser.

Equation 1 is applicable in cases with modest inlet blockage of about 5%, while Equation 2 is more applicable in cases with thin inlet boundary blockage of less than about 2%. The results of Equations 1 and 2 are shown graphically in FIG. 6 which reveals that the diffuser has a wider flow range when the leading edge blade angle (β) is at or below 10°. The relationship described by Equations 1 and 2 allow the blade angle (β) to be selected based on the desired operating range of the diffuser 13.

Optionally, especially if the required operating range of the diffuser does not allow the leading edge blade angle (β) to be less than 10°, the present invention may incorporate an annular diffuser bank 55 positioned between the impeller 12 and the leading edges of the diffuser blades 14. Use of the annular diffuser bank 55 distributes the fluid flow more uniformly before the fluid intercepts the diffuser blades and also more closely matches the fluid flow angle ($\alpha_f$) to the leading edge blade angle (β).

Without being wed to theory, it is also believed that in some centrifugal impeller designs the fluid flow angle at the outlet edge 28 is too high and requires an annular diffuser bank 55 to slow down the discharge velocity of the fluid at the outlet edge. A slower velocity, in turn, allows for a lower diffuser blade angle (β) at the leading edge 38. In another aspect, the annular diffuser 55 sometimes has an annular wall including angle ($\alpha_{incl}$ with respect to the radial direction) that is too wide and results wall boundary layer separation. In such a case, the annular diffuser 55 may also include one or more thin, annular wall splitters with an angle ($\alpha_{incl}$) of less than 4° so as to avoid the wall boundary layer separation.

The volute 15 includes a scroll-shaped casing 57 that defines an inlet slot 56 which extends 360° around the entire periphery 36 of the diffuser 13. The slot 56 allows the casing to capture the high pressure fluid exiting the radial diffuser 13. The casing 57 also defines an opening 58 having a roughly circular cross-section with an area that increases as a function of wrap angle defined by the tangential direction of the fluid flow exiting the diffuser 13. The increasing cross-sectional area helps to direct the fluid flow in the wrap angle direction. After traversing the outer circumference 36 of the diffuser, the volute extends in a tangential direction, typically as a closed tube (not shown) that is connectable to a piping system requiring the high pressure fluid. Other types of collectors could be employed with the radial diffuser 13 including a range of shrouds that enclose the diffuser and redirect various portions of the high pressure fluid flow. Such collectors could also be employed with non-radial diffuser embodiments of the present invention, such as a funnel extending from a linear diffuser bank having variable height diffuser blades.

The present invention has several advantages. The height variation between the pressure 40 and suction 41 sides in each of the channels 50 reduces the likelihood of fluid flow separation at the suction side. Reducing the likelihood of separation reduces the critical incidence angle at which stall occurs, allowing for a larger operating range of the pump or compressor. Further reduction of the incidence of stall is accomplished by coupling the blade height variation with a leading edge blade angle less than about 10°. Further advantageously, the diffuser blades 14 are stationary and at a single angle which is more cost-effective than diffuser designs having multiple blades at different angles and/or moveable blades.

Many modifications and other embodiments of the invention will come to mind to one skilled in the art to which this invention pertains having the benefit of the teachings presented in the foregoing descriptions and the associated drawings. For instance, the present invention could be generally applied to any type of diffuser wherein the diffuser includes channels having opposing pressure and suction walls with different heights so a to reduce the incidence of fluid stall. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A diffuser for converting high velocity fluid into high pressure fluid, said diffuser comprising:

a pair of spaced, opposing walls;

a pressure surface having a first height extending between the pair of spaced, opposing walls; and a suction surface having a second height extending between the pair of spaced opposing walls, said second height being greater than said first height;

wherein said walls and surfaces define a channel having a first end, a second end and a generally increasing cross-sectional area as the channel extends from the first end to the second end so that high velocity fluid entering into the first end is converted into high pressure fluid as the fluid flows through the channel to the second end.

2. A diffuser for converting high velocity fluid into high pressure fluid, said diffuser comprising:

a pair of spaced, opposing walls; and a plurality of diffuser blades, each of the blades defining a pressure surface and a suction surface, wherein the pressure surface has a first height extending between the pair of spaced, opposing walls; and the suction surface has a second height extending between the pair of spaced opposing walls, said second height being greater than said first height;

wherein said diffuser blades are spaced apart from each other so that the pressure surface of each blade is opposite the suction surface of an adjacent one of the blades, said walls and surfaces defining a channel having a first end, a second end and a generally increasing cross-sectional area as the channel extends from the first end to the second end so that high velocity fluid entering into the first end is converted into the high pressure fluid as the fluid flows through the channel to the second end.

3. A diffuser of claim 2, wherein the pressure surface has a radius of curvature ($R_p$) and wherein the suction surface has a radius of curvature ($R_s$) which is less than $R_p$.

4. A diffuser of claim 3, wherein each blade has a blade height (H(R)) that varies between the pressure surface and the suction surface as a function of a radius of curvature (R) wherein $R_p<R<R_s$.

5. A diffuser of claim 4, wherein variation of the blade height is defined as $H(R)/H=0.3535[(R_p+R_s)/R]^{3/2}$.

6. A diffuser of claim 5, wherein each blade has a leading edge angle (β) which is less than approximately 10°.

7. A diffuser of claim 2, wherein each blade has a leading edge angle (β) which is less than approximately 10°.

8. An annular diffuser for converting high velocity fluid into high pressure fluid, said diffuser comprising:

a pair of spaced, opposing walls; and a plurality of diffuser blades arranged in a generally annular, spaced relationship so that a pressure surface of one blade is opposite a suction surface of another blade, said pressure surface extending a first height between the pair of opposing walls and said suction surface extending a second height between the pair of opposing walls wherein the second height is greater than the first height;

wherein said walls and surfaces define a radially extending channel having a first end, a second end and a generally increasing cross-sectional area as the channel extends from the first end to the second end so that high velocity fluid entering into the first end is converted into high pressure fluid as the fluid flows through the channel to the second end.

9. A diffuser of claim 8, wherein the pressure surface has a radius of curvature ($R_p$) and wherein the suction surface has a radius of curvature ($R_s$) which is less than $R_p$.

10. A diffuser of claim 9, wherein each blade has a blade height (H(R)) that varies between the pressure surface and the suction surface as a function of a radius of curvature (R) wherein $R_p<R<R_s$.

11. A diffuser of claim 10, wherein variation of the blade height is defined as $H(R)/H=0.3535[(R_p+R_s)/R]^{3/2}$.

12. A diffuser of claim 11, wherein each blade has a leading edge angle (β) which is less than approximately 10°.

13. A diffuser of claim 8, wherein each blade has a leading edge angle (β) which is less than approximately 10°.

14. A centrifugal compressor for increasing a fluid pressure, said centrifugal compressor comprising:

an impeller having a plurality of rotatable blades defining a peripheral edge during rotation, said blades configured to accelerate the fluid in a radial direction during rotation so that the fluid exits at the peripheral edge; and an annular diffuser comprising:

a pair of spaced, opposing walls; and a plurality of diffuser blades arranged in a generally annular, spaced relationship so that a pressure surface of one blade is opposite a suction surface of another blade, said pressure surface extending a first height between the pair of opposing walls and said suction surface extending a second height between the pair of opposing walls wherein the second height is greater than the first height;

wherein said opposing surfaces and walls define a channel having a first end positioned at the peripheral edge of the impeller so as to receive the fluid as the fluid exits the impeller, said channel extending radially with a generally increasing cross-sectional area to a second end wherein the fluid pressure increases as the fluid flows from the first to second ends.

15. A compressor of claim 14, wherein the pressure surface has a radius of curvature ($R_p$) and wherein the suction surface has a radius of curvature ($R_s$) which is less than $R_p$.

16. A compressor of claim 15, wherein each blade has a blade height (H(R)) that varies between the pressure surface and the suction surface as a function of a radius of curvature (R) wherein $R_p<R<R_s$.

17. A compressor of claim 16, wherein variation of the blade height is defined as $H(R)/H=0.3535[(R_p+R_s)/R]^{3/2}$.

18. A compressor of claim 17, wherein each blade has a leading edge angle (β) which is less than approximately 10°.

19. A compressor of claim 14, wherein each blade has a leading edge angle (β) which is less than approximately 10°.

20. A compressor of claim 14, further comprising an annular diffuser bank positioned between the impeller and the annular diffuser.

* * * * *